US007408526B2

(12) United States Patent
Pan

(10) Patent No.: US 7,408,526 B2
(45) Date of Patent: Aug. 5, 2008

(54) ADJUSTABLE ANTENNA ASSEMBLY

(75) Inventor: Tien-Chih Pan, Nantou (TW)

(73) Assignee: Jonsa Technologies Co., Ltd., Nantou (TW)

( * ) Notice: Subject to any disclaimer, the term of this patent is extended or adjusted under 35 U.S.C. 154(b) by 28 days.

(21) Appl. No.: 11/649,560

(22) Filed: Jan. 4, 2007

(65) Prior Publication Data

US 2008/0165076 A1 Jul. 10, 2008

(51) Int. Cl.
*H01Q 1/08* (2006.01)
*H01Q 1/12* (2006.01)

(52) U.S. Cl. ..... 343/880; 343/882; 343/892

(58) Field of Classification Search ..... 343/878, 343/880, 882, 892, 757
See application file for complete search history.

(56) References Cited

U.S. PATENT DOCUMENTS 7,113,144 B2 * 9/2006 Lin et al. ..... 343/880
7,142,168 B1 * 11/2006 Sinclair ..... 343/882
7,164,391 B2 * 1/2007 Lin et al. ..... 343/882
7,265,732 B2 * 9/2007 Lin ..... 343/882
7,268,743 B2 * 9/2007 Lin ..... 343/880

* cited by examiner

*Primary Examiner*—Hoang V Nguyen
(74) *Attorney, Agent, or Firm*—Alan Kamrath; Kamrath & Associates PA

(57) ABSTRACT

An adjustable antenna assembly has an antenna bracket, an adjusting bracket and a supporting bracket. The antenna bracket has a face and two sidewalls mounted on the face. The adjusting bracket is connected pivotally to the antenna bracket and has a fixed board, two elevation boards and an adjusting device. The elevation boards are mounted on the sides of the fixed board. The adjusting device is attached to the antenna bracket and the elevation boards and has a mounting device, two mounting brackets and an adjusting post. The supporting bracket is connected to the adjusting bracket and has a connecting board and a connecting shaft. The connecting board is attached to the fixed board. The connecting shaft is a single piece and is connected to the connecting board with a connecting plate.

11 Claims, 5 Drawing Sheets

ADJUSTABLE ANTENNA ASSEMBLY

BACKGROUND OF THE INVENTION

1. Field of the Invention

The present invention relates to an adjustable antenna assembly, and more particularly to an adjustable antenna assembly to adjust a satellite antenna in signal-receiving angle.

2. Description of Related Art

To receive satellite signals such as video, telephone or the like, a satellite antenna is applied to receive and transmit signals from and to a satellite.

With reference to FIGS. 4 and 5, a satellite antenna has a concave antenna dish with a rear surface and is generally mounted on a conventional adjustable antenna assembly (60). The conventional adjustable antenna assembly (60) substantially comprises an antenna bracket (61), an adjusting bracket (62) and a supporting bracket (63).

The antenna bracket (61) is U-shaped, is attached to the rear surface of the antenna dish and has two sidewalls.

The adjusting bracket (62) is U-shaped, is connected pivotally to the antenna bracket (61) and has two sidewalls, a bottom, multiple curved slots (621), multiple fasteners (622), two mounting bricks (623) and an adjusting post (624).

The sidewalls of the adjusting bracket (62) are adjacent to the sidewalls of the antenna bracket (61). The curved slots (621) are respectively formed in the sidewalls of the adjusting bracket (62). The fasteners (622) are mounted respectively through the curved slots (621) and the antenna bracket (61) to attach the antenna bracket (61) to the adjusting bracket (62). The mounting bricks (623) are respectively mounted on one of the sidewalls of the antenna bracket (61) and a corresponding sidewall of the adjusting bracket (62). The adjusting post (624) is connected to the mounting bricks (623) to adjust and rotate the antenna bracket (61) relative to the adjusting bracket (62).

The supporting bracket (63) is connected rotatably to the adjusting bracket (62) and has a connecting board (631) and a connecting shaft (632). The connecting board (631) is connected rotatably to the bottom of the adjusting bracket (62). The connecting shaft (632) is connected securely to the connecting board (631), is opposite to the adjusting bracket (62) and has a proximal end and a connecting plate (633). The connecting plate (633) is attached to the proximal end of the connecting shaft (632) by welding and is connected to the connecting board (631).

When the fasteners (622) are loosened, the antenna bracket (61) and the antenna dish can be pivoted relative to the adjusting bracket (62) so as to adjust the signal-receiving angle of the antenna dish.

Defects and shortcomings of the conventional adjustable antenna assembly (60) as follows:

1. The mounting bricks (623) and the adjusting post (624) are mounted on one sidewalls of the antenna bracket (61) and the adjusting bracket (62), and this may cause the antenna bracket (61) and the adjusting bracket (62) deforming when rotating the adjusting post (624). Then, the thickness of the antenna bracket (61) and the adjusting bracket (62) must be increased to prevent the antenna bracket (61) and the adjusting bracket (62) from deforming. This will increase the cost of manufacturing the antenna bracket (61) and the adjusting bracket (62).

2. Since a welding process is necessary for combining the connecting plate (633) with the connecting shaft (632), this will increase the cost and time for manufacturing the adjustable antenna assembly. Furthermore, a manually welding process may result in weak joints between the connecting plate (633) and the proximal end of connecting shaft (632).

To overcome the shortcomings, the present invention provides an adjustable antenna assembly, which is strong and can be manufactured quickly and easily to mitigate or obviate the aforementioned problems.

SUMMARY OF THE INVENTION

The main objective of the present invention is to provide an adjustable antenna assembly, which is strong and can be manufactured quickly and easily.

The adjustable antenna assembly has an antenna bracket, an adjusting bracket and a supporting bracket. The antenna bracket has a face and two sidewalls mounted on the face. The adjusting bracket is connected pivotally to the antenna bracket and has a fixed board, two elevation boards and an adjusting device. The elevation boards are mounted on the sides of the fixed board. The adjusting device is attached to the antenna bracket and the elevation boards and has a mounting device, two mounting brackets and an adjusting post. The supporting bracket is connected to the adjusting bracket and has a connecting board and a connecting shaft. The connecting board is attached to the fixed board. The connecting shaft is a single piece and is connected to the connecting board with a connecting plate.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
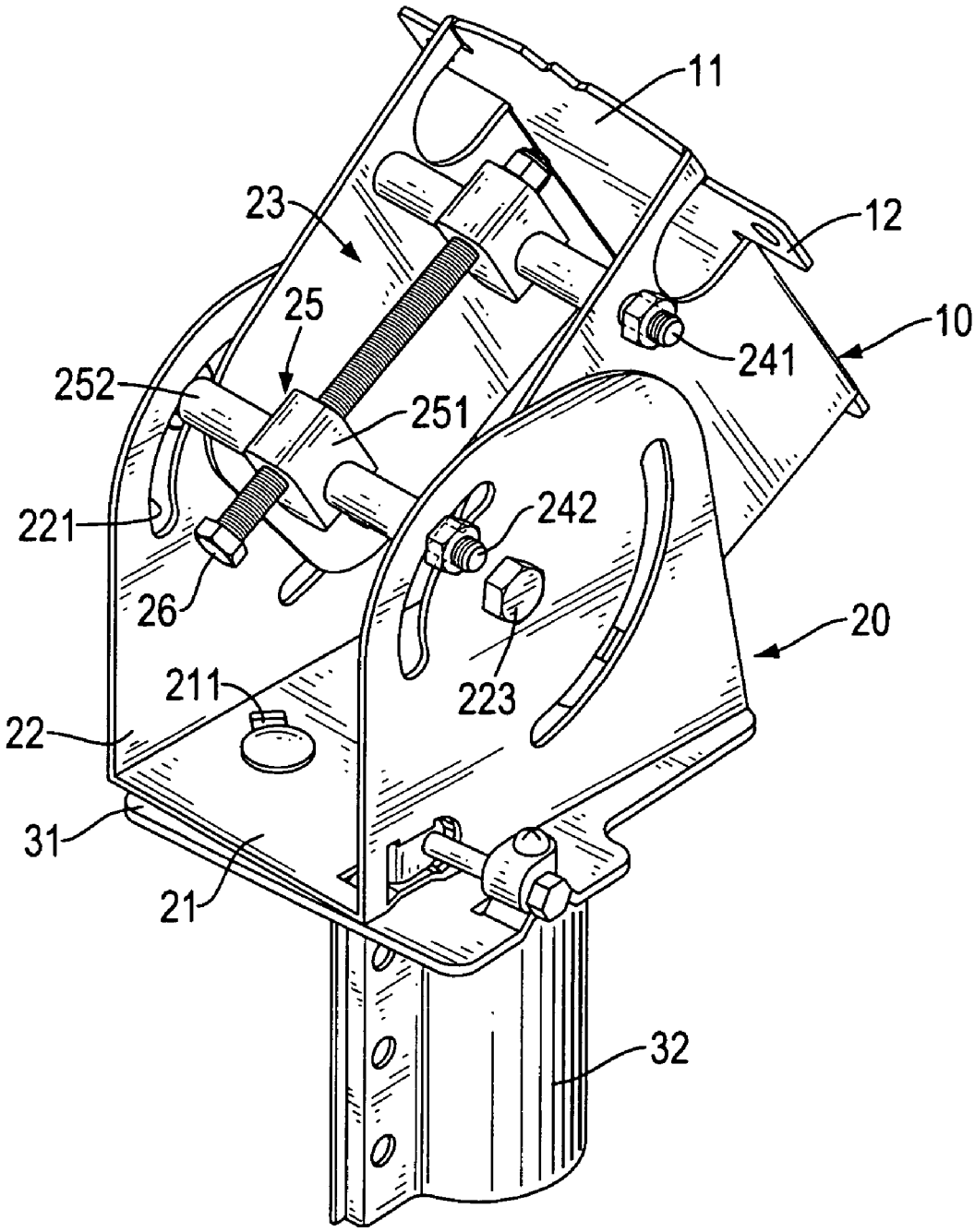
FIG. 1 is a perspective view of an adjustable antenna assembly in accordance with the present invention.
Figure 2:
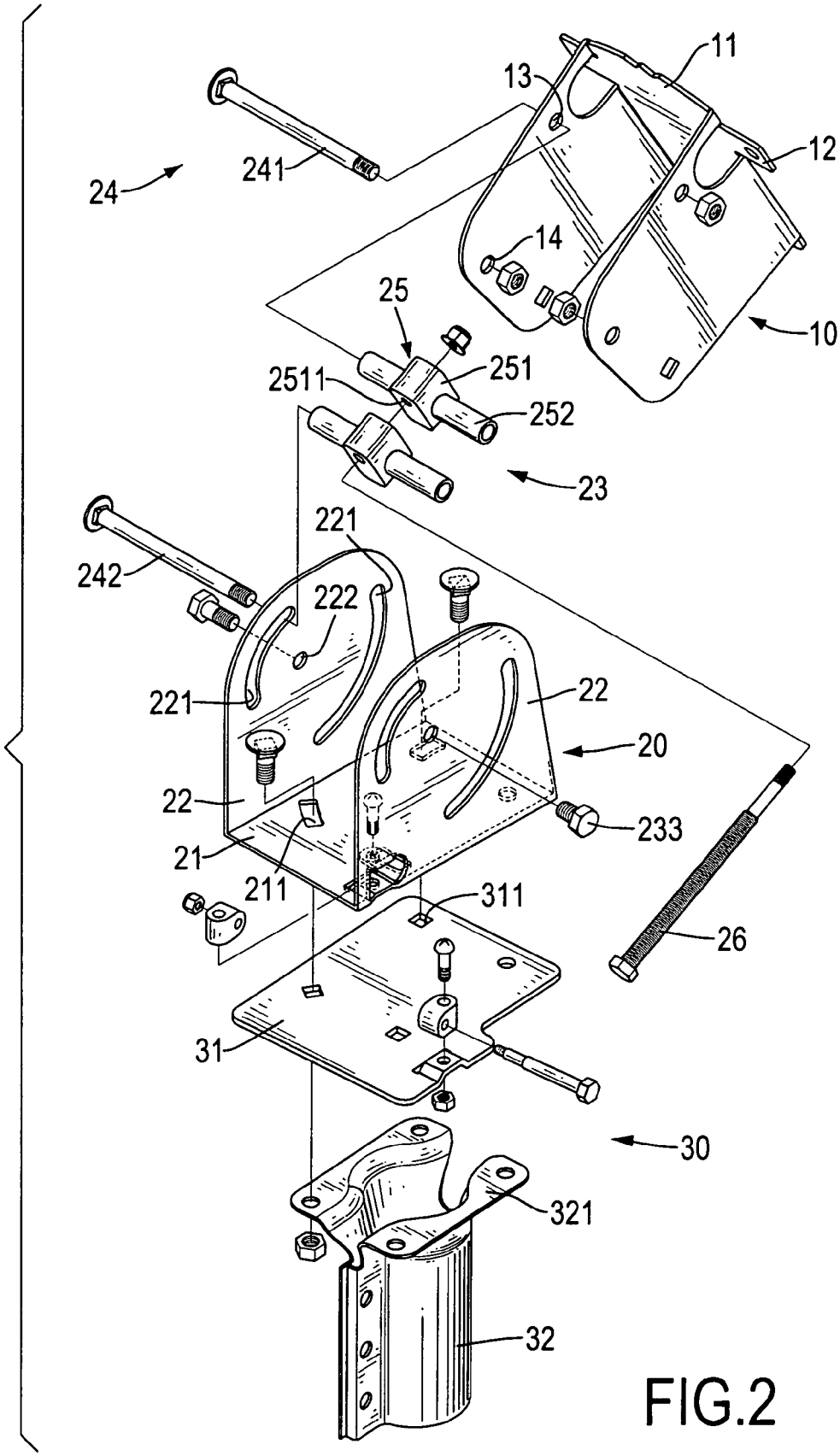
FIG. 2 is an exploded perspective view of the adjustable antenna assembly in FIG. 1.
Figure 3:
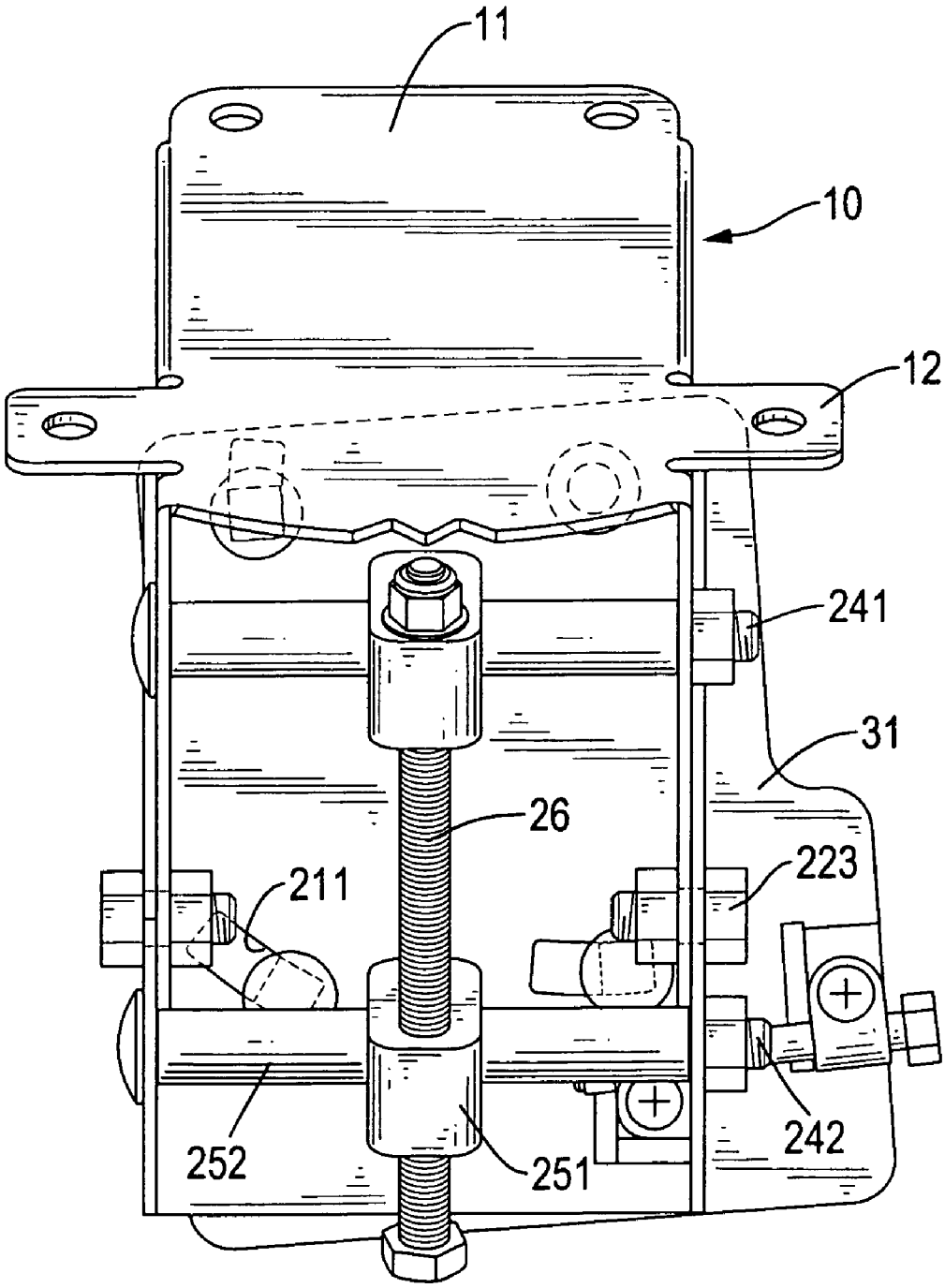
FIG. 3 is a top view of the adjustable antenna assembly in FIG. 1.
Figure 4:
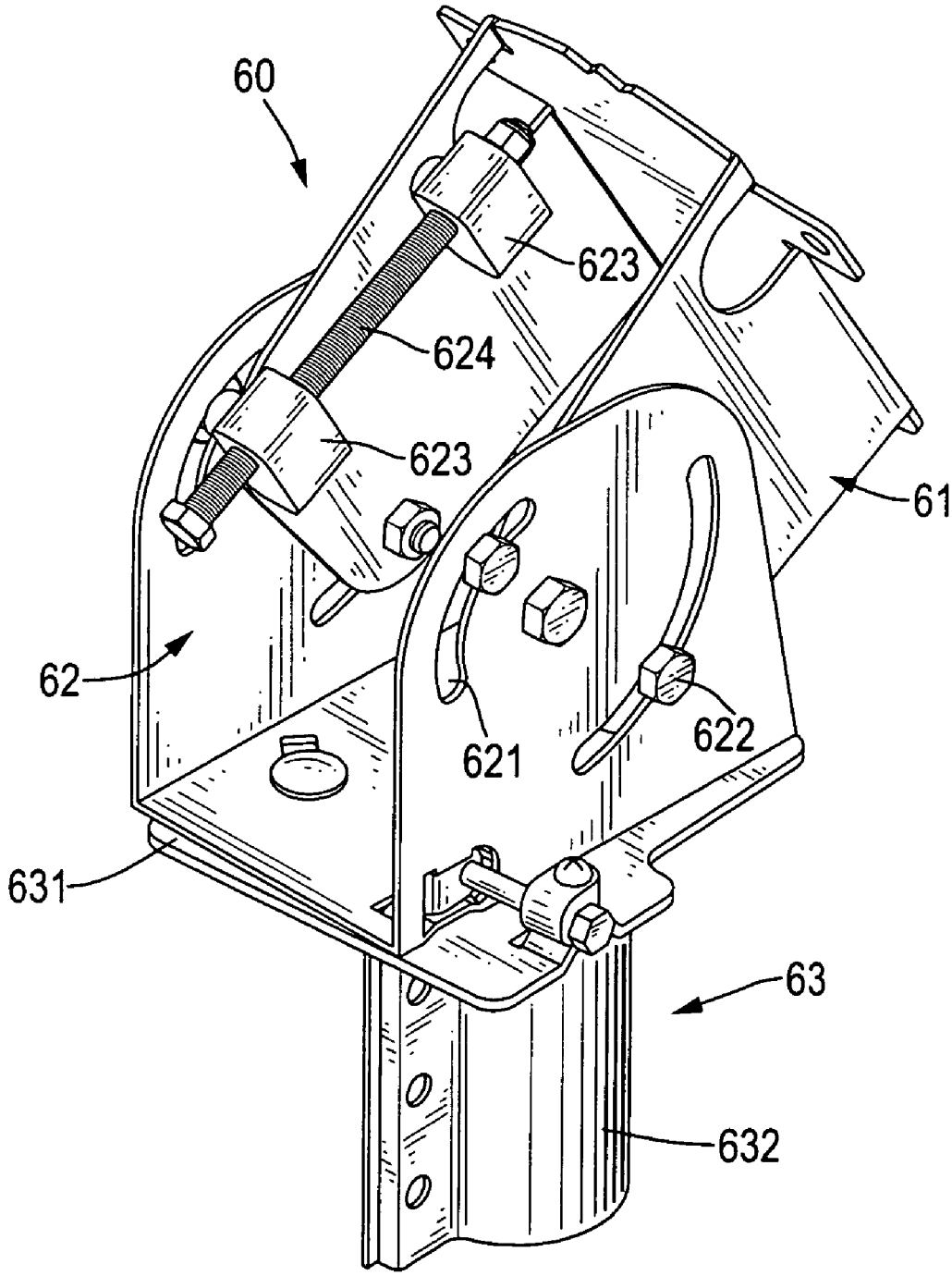
FIG.4 PRIOR ART
FIG. 4 is a perspective view of a conventional adjustable antenna assembly in accordance with the prior art.
Figure 5:
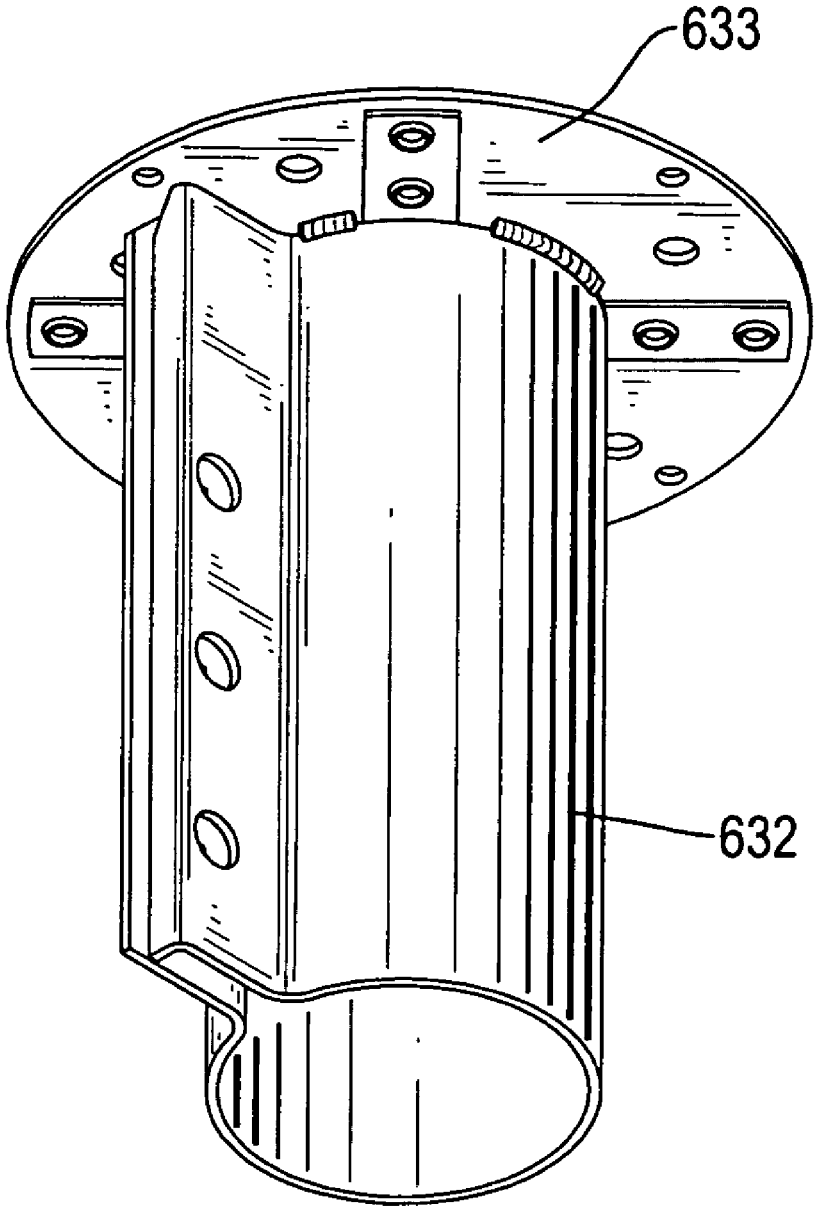
FIG.5 PRIOR ART
FIG. 5 is an enlarged bottom perspective view of the conventional adjustable antenna assembly in FIG. 4.

With reference to FIGS. 1, 2 and 3, an adjustable antenna assembly in accordance with the present invention comprises an antenna bracket (10), an adjusting bracket (20) and a supporting bracket (30).

The antenna bracket (10) is U-shaped, is used to connect with an antenna dish and has a face (11) and two sidewalls. The face (11) of the antenna bracket (10) is connected to a rear face of the antenna dish and has multiple wings (12). The wings (12) are formed on and laterally extend from the face (11) and are adapted to connect with the rear face of the antenna dish.

The sidewalls are mounted on the face (11) to form a U-shaped antenna bracket (10), correspond respectively to the wings (12) and each sidewall has a connecting hole (14) and a mounting hole (13). The connecting hole (14) is formed through the sidewall far away a corresponding wing (12). The mounting hole (13) is formed through the sidewall between the corresponding wing (12) and the connecting hole (14).

The adjusting bracket (20) is a U-shaped seat, is connected pivotally to the antenna bracket (10) and has a fixed board (21), two elevation boards (22) and an adjusting device (23).

The fixed board (21) is a square board and has two sides and multiple elongated holes (211). The elongated holes (211) are formed through the fixed board (21).

The elevation boards (22) are mounted on the sides of the fixed board (21) respectively. Each elevation board (22) has two curved slots (221), a through hole (222) and a fastener (223). The curved slots (221) are formed through the elevation board (22) and are aligned respectively with the curved slots (221) in the other elevation board (22). The through hole (222) is formed through the elevation board (22) between the curved slots (221), and corresponds to the connecting hole (14) in one of the sidewalls of the antenna bracket (10). The fastener (223) is mounted through a corresponding one of the connecting holes (14) of the antenna bracket (10) and the through hole (222) in the elevation board (22) to connect the antenna bracket (10) with the adjusting bracket (20).

The adjusting device (23) is attached to the antenna bracket (10) and the elevation boards (22) of the adjusting bracket (20), and has a mounting device (24), two mounting brackets (25) and an adjusting post (26).

The mounting device (24) is connected to the antenna bracket (10) and the adjusting bracket (20), and has a first mounting rod (241) and a second mounting rod (242). The first mounting rod (241) is connected to the mounting holes (13) in the antenna bracket (10). The second mounting rod (242) is connected to an aligned pair of curved slots (221) in the elevation boards (22).

The mounting brackets (25) are respectively mounted around the mounting rods (241, 242) and each mounting bracket (25) has a brick (251) and a mounting tube (252). The brick (251) is cubic and has an adjusting hole (2511). The adjusting hole (2511) is formed through the brick (251) and has an inner thread. The mounting tubes (252) are hollow, are extended through the bricks (251) perpendicular to the adjusting holes (2511) and is mounted around one of the mounting rods (241, 242).

The adjusting post (26) is connected rotatably to the adjusting holes (2511) in the mounting brackets (25) and has an outer thread. The outer thread of the adjusting post (26) is screwed with the inner threads of the adjusting holes (2511) in the bricks (25).

The supporting bracket (30) is connected to the adjusting bracket (20) and has a connecting board (31) and a connecting shaft (32). The connecting board (31) is attached to the fixed board (21) of the adjusting bracket (20) and has multiple through holes (311). The through holes (311) are formed through the connecting board (31) and correspond respectively to the elongated holes (211) in the fixed board (21).

The connecting shaft (32) is a single piece, is connected to the connecting board (31) and has a proximal end and a connecting plate (321). The connecting plate (321) is integrally formed on the proximal end of the connecting shaft (32) and is connected to connecting board (31) at a side opposite to the fixed board (21).

The adjustable antenna assembly as described has the following advantages.

1. The adjusting device (23) is connected to the antenna bracket (10) between the sidewalls and the adjusting bracket (20) between the elevation boards (22), and this can keep the antenna bracket (10) and the adjusting bracket (20) from deforming. Thus, to increase the thickness of the antenna bracket (10) and the adjusting bracket (20) is unnecessary, and the cost for manufacturing the antenna bracket (10) and the adjusting bracket (20) is reduced.

2. Since the connecting plate (321) is formed on the connecting shaft (32), a welding process is unnecessary and the cost and time for manufacturing the adjustable antenna assembly are reduced. Furthermore, weak joints will not occur between the connecting plate (321) and the proximal end of connecting shaft (32), and the structural strength of the supporting bracket (30) is enhanced.

Even though numerous characteristics and advantages of the present utility model have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable antenna assembly for an antenna dish with a rear face and comprising an antenna bracket adapted to connect with the antenna dish and having a face adapted to connect with the rear face of the antenna dish and having multiple wings; and two sidewalls being respectively mounted with the face;

an adjusting bracket being connected pivotally to the antenna bracket and having a fixed board with two sides;

two elevation boards mounted on the sides of the fixed board respectively; and an adjusting device being attached to the antenna bracket and the elevation boards and having a mounting device being connected to the antenna bracket and the adjusting bracket;

two mounting brackets being mounted around the mounting device; and an adjusting post being connected rotatably to the mounting brackets; and a supporting bracket being connected to the adjusting bracket and having a connecting board being attached to the fixed board; and a connecting shaft being a single piece, being connected to the connecting board and having a proximal end; and a connecting plate being integrally formed on the proximal end of the connecting shaft and being connected to connecting board at a side opposite to the fixed board.

2. The adjustable antenna assembly as claimed in claim 1, wherein the sidewalls of the antenna bracket are mounted on the face to form a U-shaped antenna bracket and correspond respectively to the wings on the face, and each sidewall has a connecting hole being formed through the sidewall far away a corresponding one of the wings; and a mounting hole being formed through the sidewall between the corresponding wing and the connecting hole;

the fixed board is a square board and has multiple elongated holes formed through the fixed board;

each elevation board has two curved slots being formed through the elevation board and aligning respectively with the curved slots in the other elevation board; and a through hole being formed through the elevation board between the curved slots, and corresponding to the connecting hole (in one of the sidewalls of the antenna bracket; and the connecting board has multiple through holes formed through the connecting board and corresponding respectively to the elongated holes in the fixed board.

3. The adjustable antenna assembly as claimed in claim 2, wherein the mounting device has a first mounting rod being connected to the mounting holes in the antenna bracket; and a second mounting rod being connected to an aligned pair of the curved slots in the elevation boards.

4. The adjustable antenna assembly as claimed in claim 3, wherein each mounting bracket has a brick being cubic and having an adjusting hole formed through the brick; and a mounting tube being extended through the brick perpendicular to the adjusting hole and mounted around the mounting device.

5. The adjustable antenna assembly as claimed in claim 4, wherein each adjusting hole of the brick has an inner thread; and the adjusting post has an outer thread screwed with the inner threads of the adjusting holes in the bricks.

6. The adjustable antenna assembly as claimed in claim 5, wherein each elevation board has a fastener mounted through the connecting hole of the antenna bracket and a corresponding through hole in the elevation board to connect the antenna bracket with the adjusting bracket.

7. The adjustable antenna assembly as claimed in claim 6, wherein the adjusting bracket is a U-shaped seat.

8. The adjustable antenna assembly as claimed in claim 2, wherein each elevation board has a fastener mounted through the connecting hole of the antenna bracket and a corresponding through hole in the elevation board to connect the antenna bracket with the adjusting bracket.

9. The adjustable antenna assembly as claimed in claim 1, wherein each mounting bracket has a brick being cubic and having an adjusting hole formed through the brick; and a mounting tube being extended through the brick perpendicular to the adjusting hole and mounted around the mounting device.

10. The adjustable antenna assembly as claimed in claim 9, wherein each adjusting hole of the brick has an inner thread; and the adjusting post has an outer thread screwed with the inner threads of the adjusting holes in the bricks.

11. The adjustable antenna assembly as claimed in claim 1, wherein the adjusting bracket is a U-shaped seat.

* * * * *